US006685189B2

(12) United States Patent
Cherven

(10) Patent No.: US 6,685,189 B2
(45) Date of Patent: Feb. 3, 2004

(54) METHOD OF PLAYING A RUMMY GAME USING STAR PLAYING CARDS AND COMPANION PLAYING CARD GAMES

(76) Inventor: Eugene Joseph Cherven, 18045 Sunburst Dr., Monument, CO (US) 80132

( * ) Notice: Subject to any disclaimer, the term of this patent is extended or adjusted under 35 U.S.C. 154(b) by 0 days.

(21) Appl. No.: 10/187,275

(22) Filed: Jul. 1, 2002

(65) Prior Publication Data

US 2003/0025271 A1 Feb. 6, 2003

Related U.S. Application Data

(60) Provisional application No. 60/310,405, filed on Aug. 6, 2001.

(51) Int. Cl.[7] ..... A63F 1/00

(52) U.S. Cl. ..... 273/304; 273/292; 273/303; 273/306; D21/376; D21/380; D21/381

(58) Field of Search ..... 273/292, 274, 273/309, 303, 304, 305, 306; 463/12, 13; D21/376, 378, 379, 380, 381

(56) References Cited

U.S. PATENT DOCUMENTS

| | | | | | |
|---|---|---|---|---|---|
| 3,502,336 | A | * | 3/1970 | Krueger, Jr. | 273/303 |
| 5,042,818 | A | * | 8/1991 | Weingardt | 273/292 |
| 5,601,488 | A | * | 2/1997 | Kadlic | 463/13 |
| 6,170,823 | B1 | * | 1/2001 | Kintner | 273/236 |
| 6,341,779 | B1 | * | 1/2002 | Merritt | 273/292 |
| 6,581,936 | B1 | * | 6/2003 | Zoccolillo et al. | 273/274 |
| 6,588,756 | B1 | * | 7/2003 | Hughes | 273/292 |

OTHER PUBLICATIONS

Wisted's California Blackjack, brochure, Commerce Casino, 1990.*

California Catch 22, County of Los Angeles Sherrif's Department Headquarters, Mar. 1995.*

21st Century Blackjack, Casino Gaming Concepts, Inc. 1994.*

Scarne's Encyclopedia of Games, "Rummy Games", John Scarne, Harper & Row Publishers, pp. 54–83, 1973.*

* cited by examiner

*Primary Examiner*—Benjamin H. Layno

(74) *Attorney, Agent, or Firm*—Barber Legal; Craig W. Barber

(57) ABSTRACT

The STAR PLAYING CARDS were designed for a New Appearance and to change the way conventional Card Games are played resulting in stimulating interest and excitement. They consist of New Celestial Bodies suits each being a different Color. The Suits are named: Stars, Blue Color; Moons, Red color; Novas, Green Color; and Clouds, Gold Color. There are four "X" Cards in each Deck and each is a different Color to match each Suit. Both the Facesides and Backsides are totally New Designs. The Characters are alpha-numeric with 8 Numbers "2" thru "9" and 6 Letters "E" thru "A" and "X". Total Card quantity in each deck is 56. The Facesides display a complete Circle Run showing how the Letters join the Numbers and the rank of each Character. A large Suit Symbol and Character is displayed at the center of each Card for easier Card recognition. The Backsides and the "X" Cards° Facesides show an Eclipse Design of all four Suit Symbols. The Cards are produced as poker size, 63 mm×88 mm and Casino Quality. Matching the "X" Cards Color with a Suit or using different "X" Cards Color than the Suit, allows different scores and different Hands in playing the Games. Included are 4 New Games that use the New Playing Cards: Flush 22 and Wildcat 22 played similar to Blackjack; 4Xpoker played similar to Poker and Star Rummy played similar to Contract Rummy. High Hands in Flush 22 and Wildcat 22 are 22 points in place of 21.

8 Claims, 10 Drawing Sheets

BONUS MELD-USE FOR ANY DEAL

Bonus Run: For each Wild Card color matched to the Suit.....Subtract 25 pts.

Bonus Set: All 4 Natural Suits in the Set.....Subtract 50 pts.

OPTIONAL MELD RUNS- USE FOR 6TH DEAL ONLY (one Option maximum)

Excess Cards can be used to meld a maximum of 3 additional Runs of 3 or 4 cards

1. Letter Run: all 5 Natural Lettered Cards.....Subtract 50 pts.
2. Number Run: All 8 Natural Numbered Cards.....Subtract 75 pts.
3. Full Circle Run: All 13 Cards of the suit, Wild Cards OK.....Subtract 100 pts.
4. Full Circle Run: with 4 different color Wild Cards.....Subtract 125 pts.
5. Full Circle Run: All 13 Natural Cards of the Suit.....Subtract 150 pts.

Fig. 19

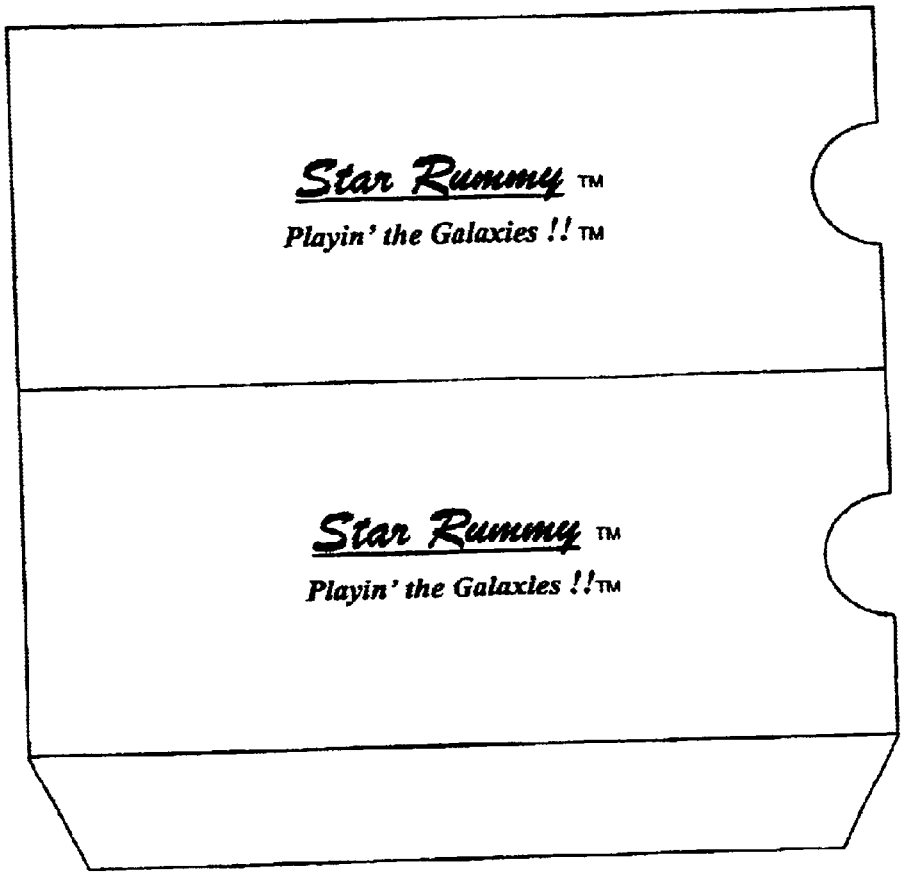

Fig. 20

*Star Rummy* ™ Score Pad

Players Names: Select Play Option(s): 1 2 3 4 5

| DEAL | | | | | | | | | | |
|---|---|---|---|---|---|---|---|---|---|---|
| | | | | | | | | | | |
| 1 | | | | | | | | | | |
| 2 | | | | | | | | | | |
| 3 | | | | | | | | | | |
| 4 | | | | | | | | | | |
| 5 | | | | | | | | | | |
| 6 | | | | | | | | | | |

For Instructions, unfold the score sheet on the bottom of the Pad

Fig. 21

INSTRUCTIONS:

Select Optional methods of Play by circling the Option(s) desired.

Deal 1 line is total scores.

Deals 2 to 6 upper lines are additions or subtractions and lower lines are total scores.

For Players who have Bonus Meld in any Deal, or Optional Meld in Deal 6, subtract that Meld Point Value from their Score and place a Minus Sign (—) ahead of all subtractions and Negative Scores. See pages 7 thru 10 of the Rules Booklet or the 7th Meld Sign for further information.

REPLACEMENT ORDERS:

You may order replacement *Star Rummy* ™ : Score Pads, Card Decks, Sign-Sets, or Game Rules at our Website.

*Celexes Games* Inc. www.1001site.com Form No. 44023

Fig. 22

METHOD OF PLAYING A RUMMY GAME USING STAR PLAYING CARDS AND COMPANION PLAYING CARD GAMES

CROSS-REFERENCE TO RELATED APPLICATIONS

This application claims the benefit of the following provisional application.

Title: Star Playing Cards and Companion Playing Card Games

Application No.: 60/310,405

Filing Date: Aug. 6, 2001

Relationship: A Provisional Patent Application on the same Invention

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Field of endeavor: New Playing Cards and Playing Card Games for use in Homes, Casinos, Internet Casinos, Video Gaming Machines, and Card Rooms.

BRIEF SUMMARY OF THE INVENTION

The Star Playing Cards were Developed to create new ways to play traditional Card Games and to inject a New Visual interest to increase the number of Casino Players. This was accomplished with the use of: 4 different color Suit Symbols in place of 2 color Suit Symbols; the use of 4 added "X" Cards, the same colors as the Suits in the New 56 Card Decks. Both the Facesides and the Backsides are redesigned yet the Cards can be used to also play most traditional Card Games and the 4 new Games.

BRIEF DESCRIPTION OF THE SEVERAL VIEWS OF THE DRAWINGS

FIG. 1: Number 2 in the Stars Suit a Blue Color; FIG. 2 Number 2 in the Moons Suit a Red Color; FIG. 3 Number 2 in the Clouds Suit a Gold Color; and FIG. 4 Number 2 in the Novas Suit a Green Color. Each Suit has 13 Characters as shown in the Full Circle Runs On each Card. Cards are poker Size.

FIG. 5 Shows numbered Cards having the least Design representing the lower rank Cards; FIG. 6 Shows lettered Cards having a greater Design representing the higher Rank Cards, FIG. 7 Shows the "A" Card having the most Design and is the highest rank. FIG. 8 Shows the Backside Design and an Eclipse of all four Suit Symbols. These come in 4 different colors for Home Games.

FIGS. 24, 25: Depict the Billiard Cloth Table Layouts. Approximate size 42×76 inches. The Background Color is Green for the FLUSH 22 Game and a Burgundy Color for the WILDCAT 22 Game. The printed Colors are white, Black, Red, and Yellow or other contrasting Colors. A Casinos name may also appear. Layouts guide the Players on how to place their Bets and what payoff ratio to expect when they get a winning Score. Each Layout has different wording.

FIGS. 19 and 20: Depict the 7th Sign for Bonus and Optional Meld and a Sleeve for storing all 7 Signs. The Sleeve is shown in an unfolded view to show the wording on each side.

FIGS. 21 and 22: FIG. 21 Depicts the STAR RUMMY Game Score Pad. The Pad consists of 20 score sheets all gummed together at the top. FIG. 22 Depicts the "Instructions for use" which is displayed when the bottom Score sheet is unfolded.

DETAILED DESCRIPTION OF THE INVENTION

Figure 1:
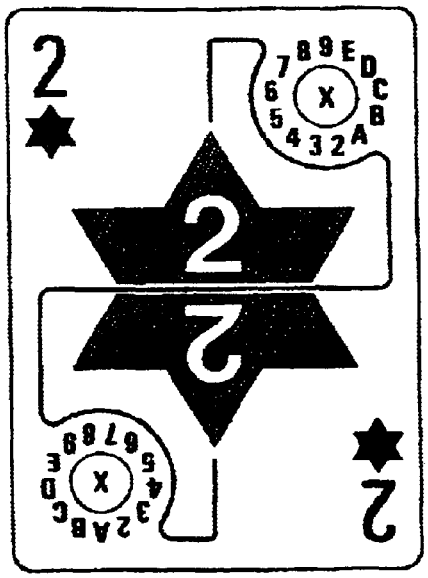
FIGS. 1 thru 4: Depict the four Suits.
Figure 2:
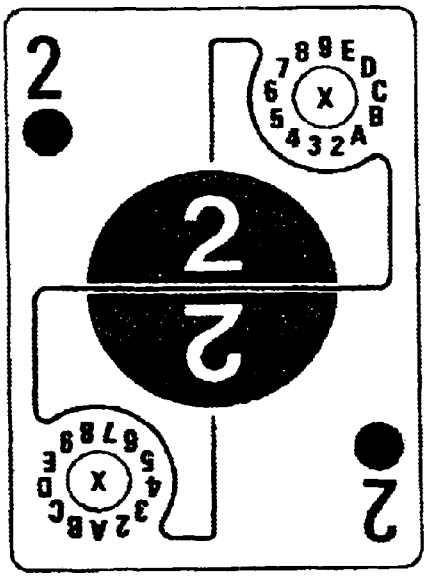
Figure 3:
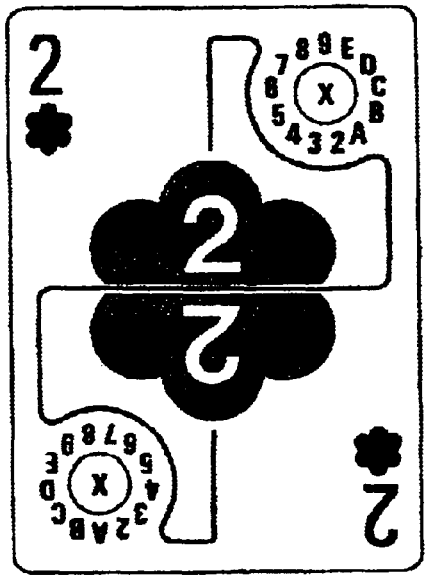
Figure 4:
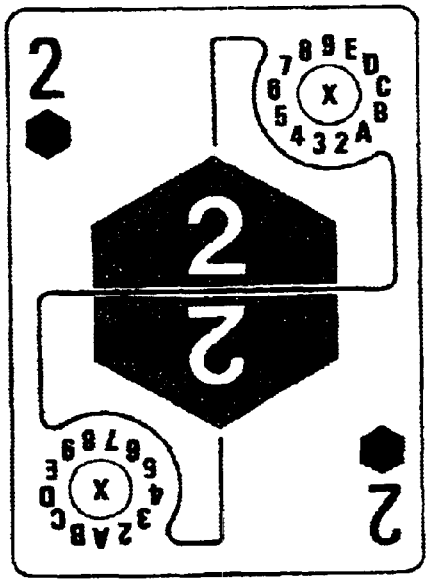
Figure 5:
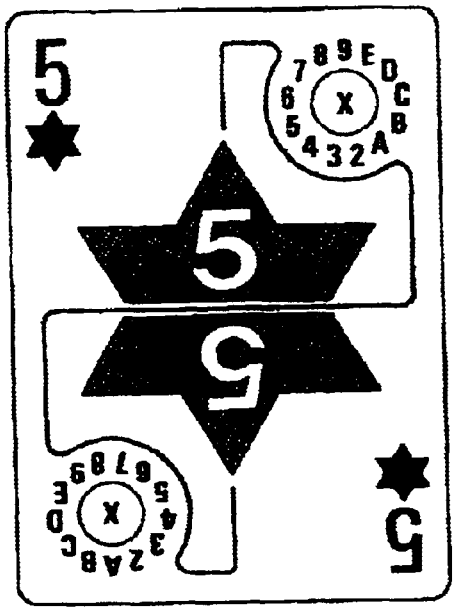
FIGS. 5 thru 8: Depict the Facesides of the Cards in the three design levels.
Figure 6:
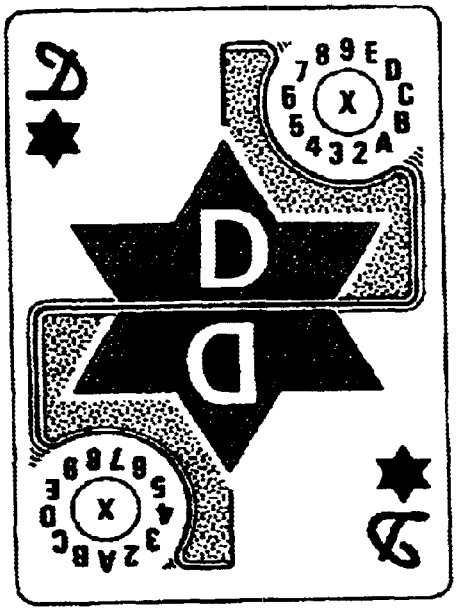
Figure 7:
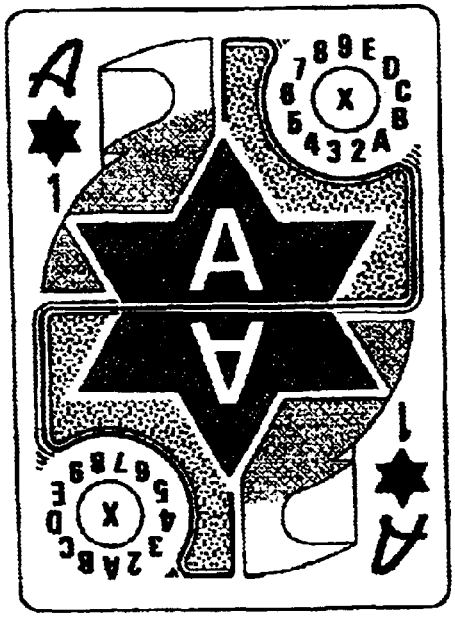
Figure 8:
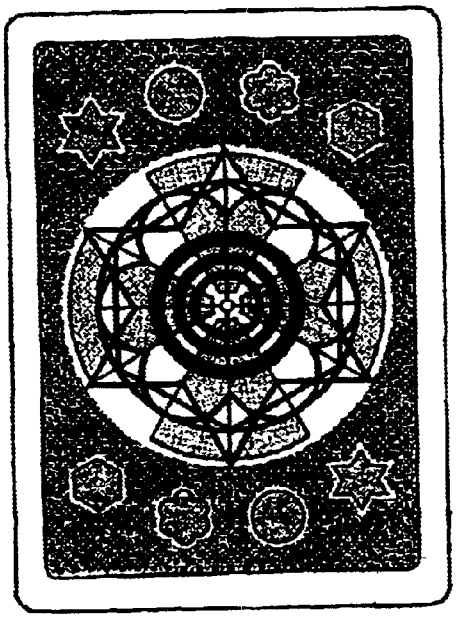
Figure 9:
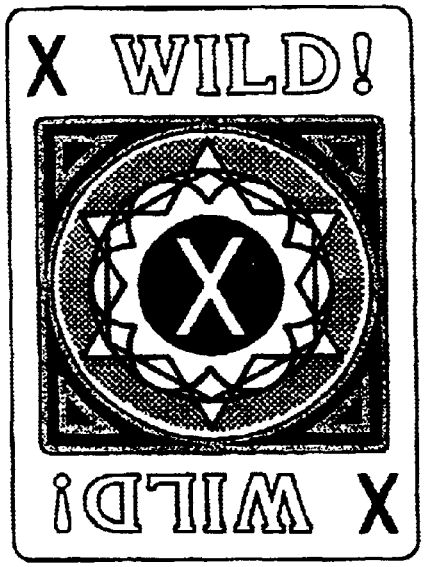
FIGS. 9 thru 12: Each figure depicts the Facesides of the "X" Cards which are each a different color to match the suit colors. The Eclipse Design is also shown on the "X" Cards.
Figure 10:
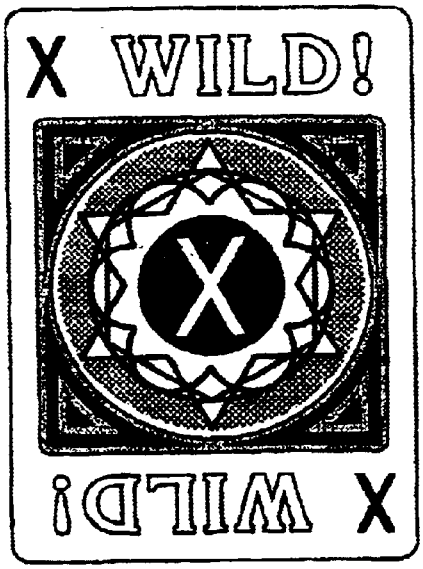
Figure 11:
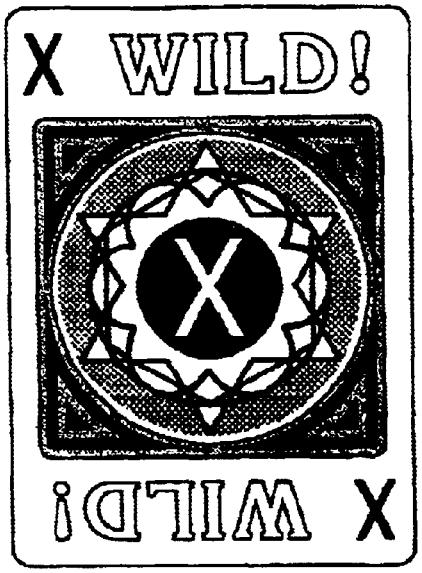
Figure 12:
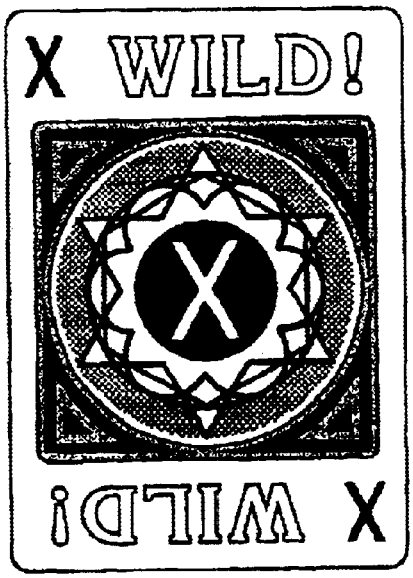
Figure 13:
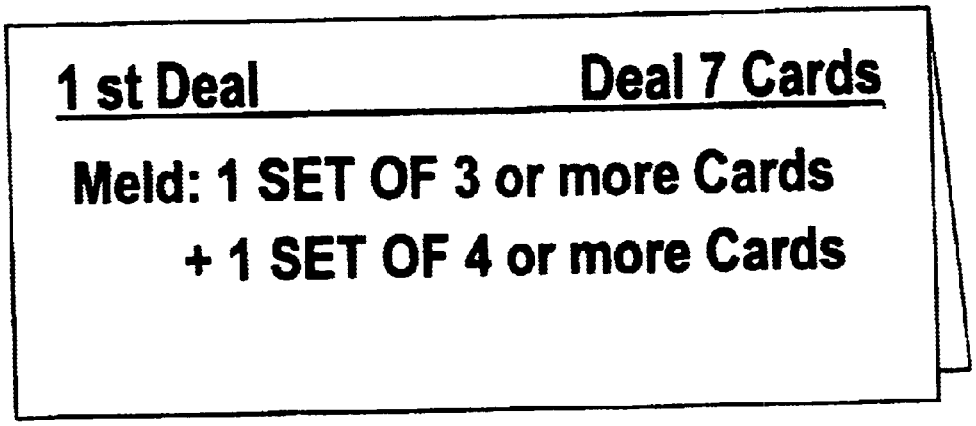
FIGS. 13 thru 18: Depict the six Signs which are the Basic Meld required for each of the six hands in the STAR RUMMY Game. The 6 Signs stand upright on the Table in one stack which can be read from Both sides.
Figure 14:
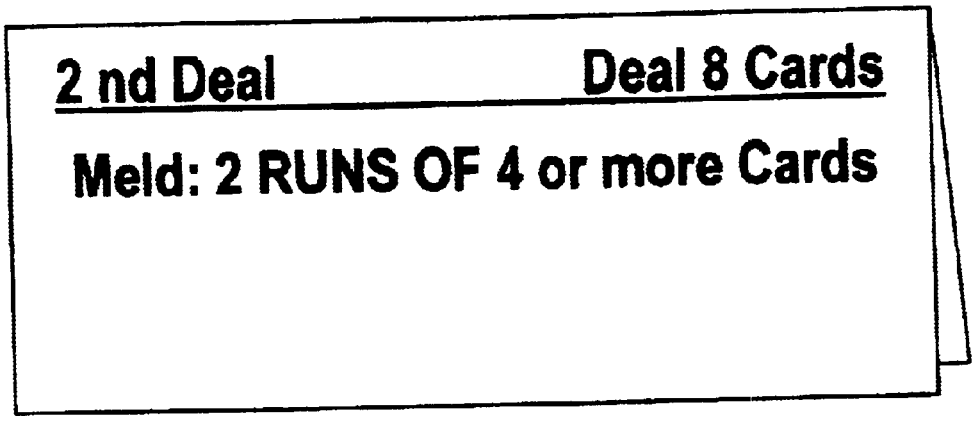
Figure 15:
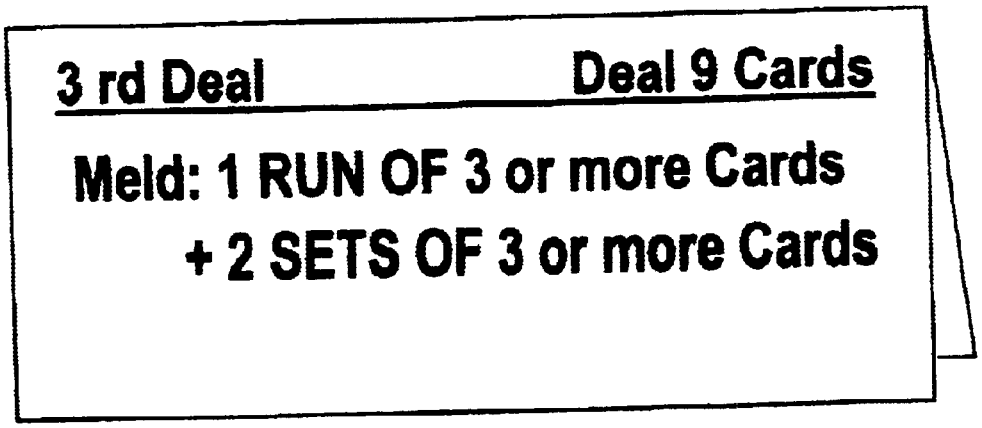
Figure 16:
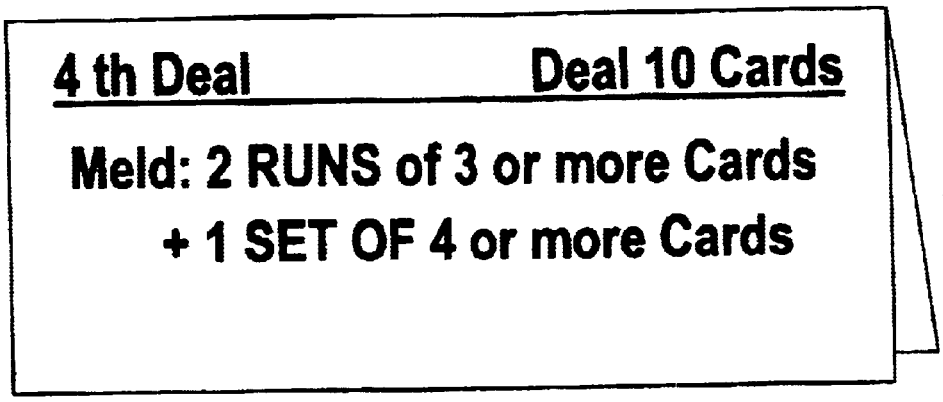
Figure 17:
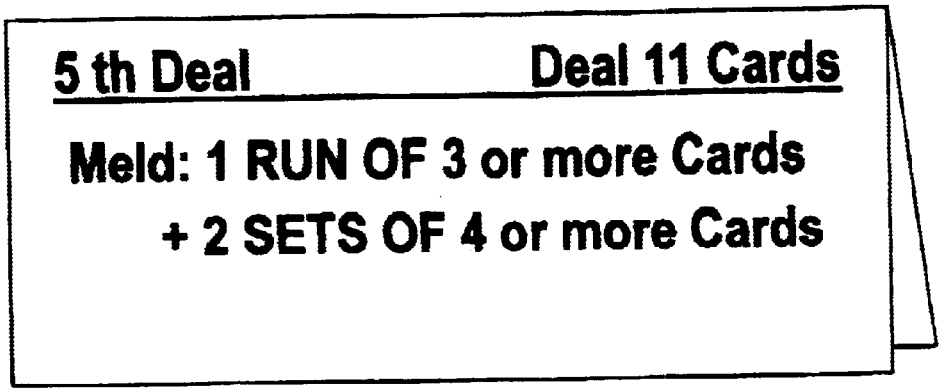
Figure 18:
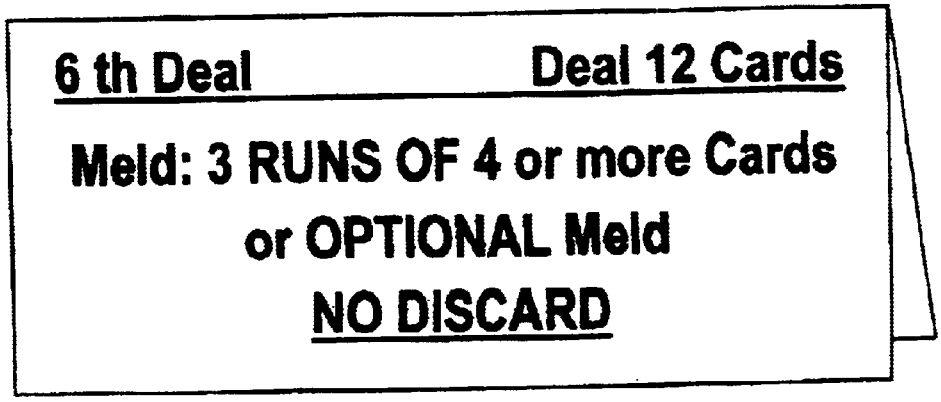
Figure 23:
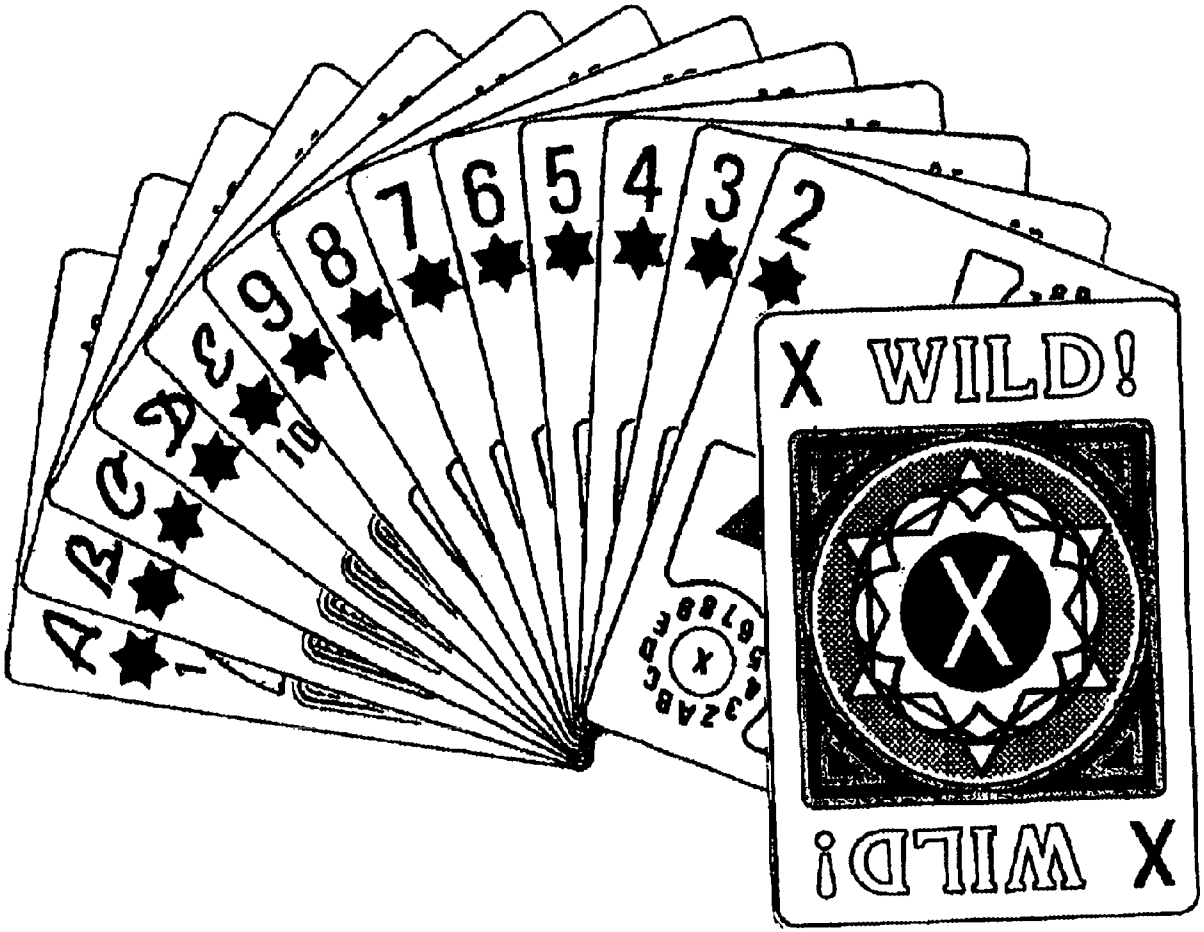
FIG. 23 depicts a complete Stars Suit with a matched Blue Color Wild card.

STAR PLAYING CARDS: Totally New Design 4 color PLAYING CARDS with New Celestial Bodies Suits; shown FIGS. 1 thru 4, FIGS. 5 thru 8, and FIGS. 9 thru 12. The Cards measure 63×88 mm, Poker Size. They were Developed to create new ways to play traditional Games and to inject a New Visual interest for Home Games and Casino Games. This was accomplished with the use of 4 different color Suit Symbols in place of 2 color Suit Symbols; and also with the use of 4 added "X" Cards, the same colors as the Suits. Both the Facesides and the Backsides are redesigned yet the Cards can be used to play most of the traditional Card Games as well as 4 New Games. Each Deck now has 56 Cards in place of 52. The Instructions are packaged for Home use with 2 Decks that have 2 different color Backsides for easy deck separation. The Casinos normally Print their own design on the Backside. Also included in the 2 Deck Box are the Game rules for Games 1, 2, and 3 described below.

The Invention includes 4 New Games described below which can be played only with the New Design STAR PLAYING CARDS described above:

GAME 1: FLUSH 22, a Casino or Home Game played similar to BLACKJACK. The "X" Cards are Valued at 1 OR 11 Points. The Game Has New Hands called MAX-HI (same color Cards) and MAX-LO (odd color Cards) with a New High Score of 22 in place of a NATURAL Score 21. INSURANCE Bets are offered more and paid less creating less frequent but higher payoffs to the players as compared to BLACKJACK which pays more frequent but lower payoffs. This is due to the possible 48 combinations for Max Hands verses 20 possible combinations for Natural Hands.

Figure 24:
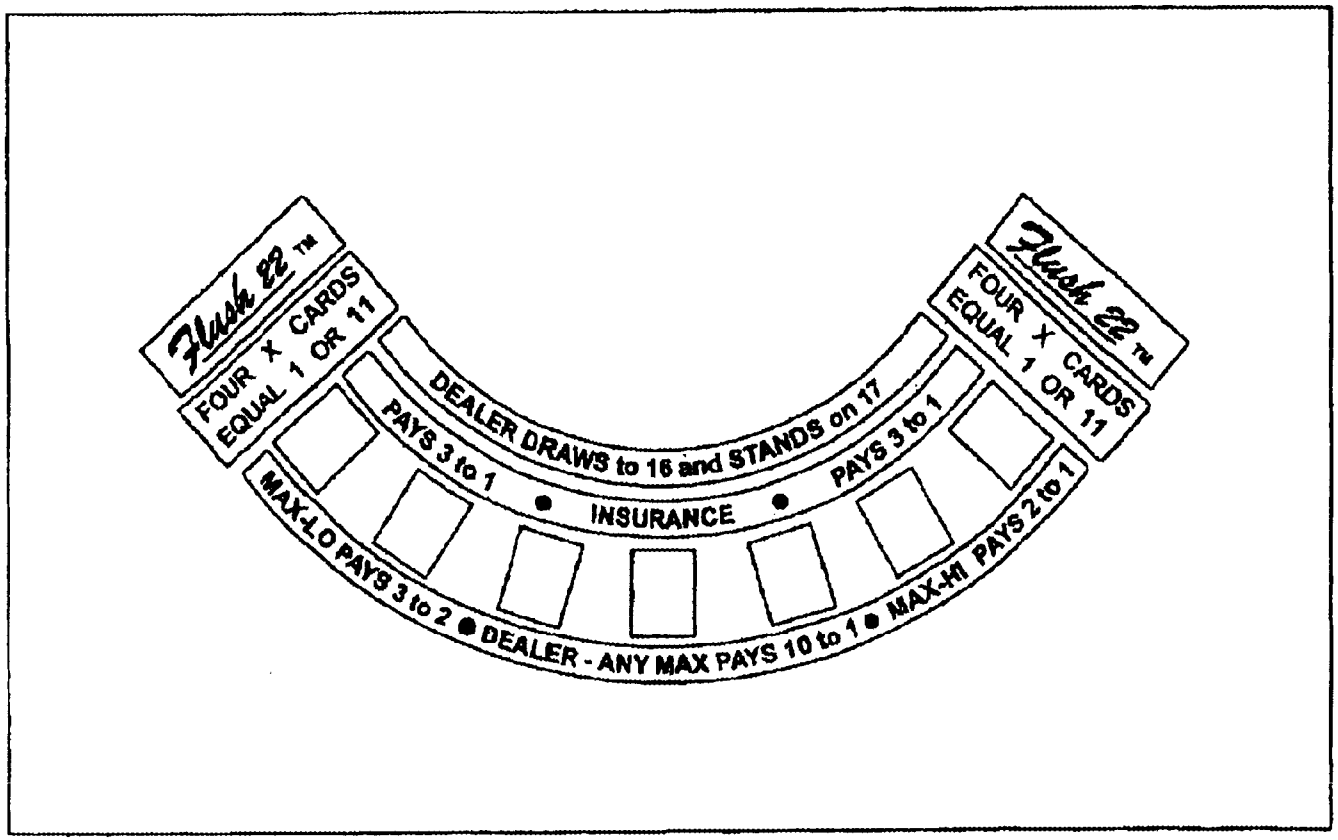
Figure 26:
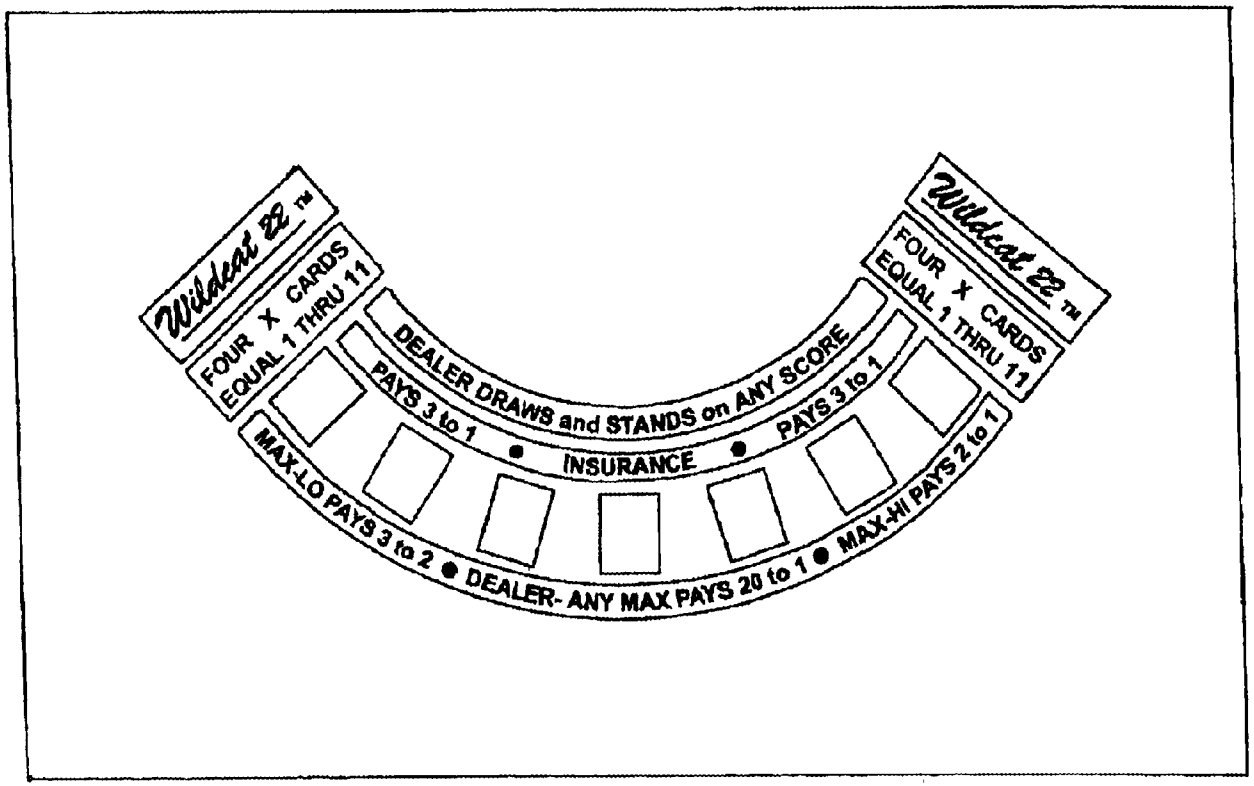

New SPECIAL Bets Pay 10 to 1 if Dealer gets any Max Hand creating more ways to Bet for the Players. In a Casino, FLUSH 22 is played on a Special green Color Cloth Layout with unique Printing as shown in FIG. 24.

GAME 2: WILDCAT 22, a Casino or Home Game played similar to BLACKJACK The "X" Cards are Valued at 1 thru 11 Points. The Game Has New Hands called MAX-HI (same color Cards) and MAX-LO (odd color Cards) with a New High Score of 22 in place of a NATURAL Score 21. This Game is very exciting as many high scores are obtained and Bust scores (over 22) are less frequent. INSURANCE Bets are offered more and paid less creating less frequent but higher payoffs to the Players as compared to BLACKJACK which pays more frequent but lower payoffs. This is due to the possible 48 combinations for Max Hands verses 20 possible combinations for Natural Hands.

New Special Bets Pay 20 to 1 if Dealer gets any Max Hand creating more ways to bet for the Players. In a Casino, WILDCAT 22 is Played on a special Burgundy Color Cloth Layout with unique Printing shown in FIG. 25.

GAME 3: 4XPOKER, A Casino or Home Game played similar to 3, 5, or 7 Card Poker. 5 OF A KIND is a New regular Hand and obtained with the use of the "X" Cards. It is ranked between 4 OF A KIND and a STRAIGHT FLUSH. When using "X" Cards in a STRAIGHT FLUSH Hand they must be the same color as the Suit otherwise the hand is downgraded to a STRAIGHT Hand. Hands made with all Cards of the Same Color outrank Hands made with Cards of Odd Colors. Like in conventional Poker, The casinos take a percentage of each pot as their earnings. There is no printing on the table Cloth.

GAME 4: STAR RUMMY, A Home Game played similar to CONTRACT RUMMY. The following are the differences in the way the game is played:. Special Bonus and Optional Meld allows subtracting Points from your score and possible wins with Negative Number Scores. Includes a Basic meld Sign-Set of 7 Signs placed upright on the Table for quick reference to the Bonus Meld, Optional meld, and the changing Meld requirements of each Deal. There are 5 optional ways to play the Game. The Game Box includes 4 Decks of STAR PLAYING CARDS that have different color Backsides for easy separation of Decks. A Score Pad is also included.

FURTHER DISCLOSURE

DISCUSSION OF CARDS

Finally, Playing Cards with a totally New design for the 21st Century and beyond. Featuring: Celestial Bodies for the Suit Symbols; a different color for each Suit with a large Suit symbol at the center and Alpha-Numeric Characters.

Each Suit has 13 Cards which consists of lettered Cards "A" through "E" and numbered Cards "2" through "9". There are 4 Wild Cards (X) which are colored the same as the Suits. Each Deck has 56 Cards including the 4 Wild Cards.

Most Card Games can be played with these Cards in a normal manner. However, specific Game titles such as shown herein require the different colored Wild Cards to play the Game. For most other Games, the colors of the Wild Cards have no meaning The Wild Cards may be removed as desired when the Game does not require them.

The New Suits are identified By these names and colors:

- ★ Stars, blue
- ⬢ Novas, green
- ● Moon, red
- ✤ Clouds, gold

Note: A Nova is a dim Star that suddenly turns very bright and then dim again for long periods of time. All Card Backsides and the Wild Card Facesides show all four Suit Symbols in an Eclipse design.

The Full Circle Runs shown on the faceside of each Card helps you remember the correct Run sequence where the Letters join the Numbers. The "1" shown on the "A" Card and the "10" shown on the "E" Card are also for that purpose.

This Table shows the Character comparisons between the Star lettered Cards and Conventional Playing Cards. The Index Value changes when Playing the Flush 22™ And Wildcat 22™ Games.

| Index Value (rank) | Star | Conventional |
|---|---|---|
| 1 or 14 | A | Ace |
| 13 | B | King |
| 12 | C | Queen |
| 11 | D | Jack |
| 10 | E | 10 |
| any | X(wild) | Joker |

For Games which have ranking Suits, this Table compares the Star Suits with Conventional Suits.

| | | | |
|---|---|---|---|
| Highest Suit: | Stars | are equal to | Spades |
| | Moons | are equal to | Hearts |
| | Novas | are equal to | Diamonds |
| Lowest Suit: | Clouds | are equal to | Clubs |

STAR RUMMY GAME RULES

A quality Rummy type Card Game with New Design Cards and Unique Meld for subtracting Points. It is loaded with fun and challenge for 2 to 10 Players, ages 8 to adult. The more Players, the more fun. Use of a Card Tray to move the Cards from Player to Player is recommended.

The Game Features: Beautiful and new cards; special "Bonus Meld" Optional "Full Circle" and "Letter" Run sequences; Optional methods of play; a different mandatory Meld combination for each Deals and the Basic Meld "Sign-Set" for quick reference to the changing Meld requirements and Deal quantity.

The Cards with the Colorful "Celestial Bodies" Suit Symbols, alpha-numeric Characters and matching color Wild Cards. Each Deck has 56 Cards which consist of 4 different colored Suits and 4 Wild Cards. Each Suit has 8 Cards numbered "2" to "9" and 5 Cards with Letters "A" to "E" . The Suit Shapes are identified by these Names and Colors:

- ★ Stars, Blue
- ⬢ Novas, Green
- ● Moons, Red
- ✤ Clouds, Gold

The "Full Circle Run" displayed on the faceside of each Card helps you remember the correct Run sequence where the Letters join the Numbers. The "1" shown on the "A" Card and the "10" shown on the "E" Card are also for that purpose.

Note: The cards can also be used to play most other Card Games.

The Star Rummy Game set includes the following items:

4 Card Decks, each with a different color backside.

1 Basic, Bonus, and Optional Meld Sign-Set with sleeve.

1 Score Pad.

For 2 to 4 Players, use 2 Decks (112 Cards)

For 5 to 7 Players, use 3 Decks (168 Cards)

For 8 to 10 Players, use 4 Decks (224 Cards)

Each Deck is colored either Blue, Red, Green or Gold on the Backside for ease in separating them.

All numbered Cards are valued at 5 Points, and lettered Cards "B" through "E" are 10 Points. The letter "A" Cards are 20 Points and the "X" (Wild Cards) are 50 Points.

The Challenge is to obtain the lowest Score of 6 Deals by being the first to lay down all the Cards in your Hand as quickly as possible. The Cards remaining in your Hand count against you.

The fun is in the interaction when several Players say "May 1" to obtain the Discard; forcing a Player to draw one more Card when they forget to say "One Card Left"; and getting "Bonus" or "Optional" Meld to reduce your Score.

Place the Basic Meld Sign-Set on the Table with the $1^{st}$ Deal Sign showing, and the other 5 Signs in Deal sequence underneath. To change Deals, move the top Sign of the group to the bottom.. Place the Optional Meld Sign on the Table by itself.

A Game consists of 6 Deals. All Cards must be shuffled for each Deal. Cutting is not required. The Deal rotates clockwise, the same as the turn sequences Deal one Card at a time to each Player face-down.

Note: The Sign-Set also shows the quantity of Cards to be dealt. The quantity of Cards for each Deal and basic Meld are identical.

This is so you can go out faster if you are dealt a near "Pat Hand".

The $1^{st}$ Deal quantity is 7 Cards. Increase the Deal quantity by one Card on every Deal thereafter, dealing 12 Cards on the $6^{th}$ Deal. The remaining Cards are placed in a Card Tray face-down which forms the Stockpile. Remove one Card from the Stockpile and place it face-up in the other Tray to form the Discard Pile.

The turn sequence is clockwise. The Player to the Dealer's left starts first. Each in-turn Player draws one Card from the top of either the Discard Pile or the Stockpile.

Whenever in-turn Players draw from the Discard Pile, additional Discards may be drawn from that Pile, provided another Card for each additional Discard drawn is taken from the Stockpile. Additional Cards cannot be drawn from the Stockpile. Except when going out, the in-turn Player must always discard one Card when their play is complete.

If the stockpile sets used up, remove all cards from the discard tray. take the top Card and place it in the empty tray. The remaining Discards are reshuffled and placed in the Stock Tray.

The object is to obtain Runs and Sets to lay down as Meld. The first Meld must be the Basic Meld for the 1st Deal as shown in "Basic Meld" below. Once melded, Natural Cards cannot be moved from their original rank position.

Thereafter, except for the $6^{th}$ Deal, a Player who has melded may lay off Cards on their own or any other Players' Meld on the Table, but cannot meld additional Runs or Sets. Melding or laying off can only be done during your turn, after drawing, and before discarding. The Basic Meld changes for each Deal as shown in "Basic Meld" below. The "Sign-Set" also has the same information.

Each Deal has a requirement of obtaining a different "Basic Meld" combination before you can lay down, as shown below. Additional matching Cards may be melded along with the Basic quantity. Additional Runs or Sets cannot be melded except for the "Optional Runs" in the $6^{th}$ Deal.

1st Deal: 1 Set of 3 or more Cards & 1 Set of 4 or more Cards.

2nd Deal: 2 Runs of 4 or more Cards.

3rd Deal: 1 Run of 3 or more Cards & 2 Sets of 3 or more Cards.

4th Deal: 2 Runs of 3 or more Cards & 1 Set of 4 or more Cards.

5th Deal: 1 Run of 3 or more Cards & 2 Sets of 4 or more Cards.

6th Deal: 3 Run of 4 or more Cards.

The 6th Deal cannot have a Discard when melding.

Note: For methods to reduce your Score, see "Bonus Meld" and "Optional Meld for 6th Deal".

A Set consists of 3 or more Cards with like Numbers or Letters, and mixing any color Suits. A Run consists of 3 or more Cards with Letters/Numbers in sequence and in the same colored Suit. When the "Basic Meld" requires 2 Runs, they may be in the same or a different colored Suit.

Runs may be built by joining the Letter "A" with the Number "2" or joining the Letter "E" with the Number "9". This is shown in the Full Circle Runs printed in the corners of each Card.

Runs may not be more than 13 Cards including Wild Cards, either when first melded, or by laying off onto them. Sets have no maximum quantity.

To reduce your Score, try to obtain the following Bonus Meld throughout the Game:

Run For each Wild Card color matched with the color of the Suit in a Basic Meld Run . . . . subtract 25 Points.

Set For each Basic Meld Set containing all four Suits without the use of Wild Cards . . . . subtract 50 Points.

Any Player can claim the last Discard, or the first Discard laid out by the Dealer, by saying "May 1" , if the next in-turn Player does not want it. IF more than one Player claims it, the Claimant nearest the left side of the in-turn Player gets it. On receiving the Discard, a second Card must be taken from the Stockpile. Once a Claimant says, "May 1" they cannot refuse to draw the Discard. Claimants do not make discards after drawing Discards.

The Claimant may also draw additional Discards. For each additional Discard drawn, the Claimant must take a second Card from the Stockpile. After the first Claimant is through, other Players may now say "May 1" to draw Discards that are now on top of the Discard Pile following the same Rules as stated previously.

The "X" Card is the only Wild Card. Any color or quantity of Wild Cards may be used to complete any Basic Meld Run or Set and Option 3. They cannot be used in Bonus Meld Sets or Options 1,2 and 5. Certain colors are required for Bonus Meld Runs and Options 4, otherwise the colors have no meaning.

The following moving or exchanging of Wild Cards can only be done by an in-turn Player who has already melded. They cannot be moved to make additional Runs or Sets or be moved for any other reason except as stated below. The Rules apply to any Meld on the Table.

The Wild Card, in a melded Run, may be moved to either end of the Run by a Player who can lay down the Natural Card in it's place.

Also, a Wild Card, in a melded Run or Set may be claimed in exchange for the Natural Card by a Player who can lay down additional Cards with the use of the Wild Card.

Note:

1. If taken from a Bonus Meld Run, the Player with that Run loses the Bonus Points.
2. If taken from a Set which has 3 different Suits, the Player with that Set may get the missing $4^{th}$ Suit and Bonus Points.

This Rule applies to all Deals except the $6^{th}$. When a Player will have one Card left in their Hand after discarding, they must say, "One Card Left", Prior to releasing their Discard. If they forget to say this, any Player can say "Draw One," and the in-turn Player must draw one more Card. The levy cannot be imposed after the next Player completes their play.

It is not necessary for that player to repeat, "One Card Left," when melding or discarding their next Card drawn.

Deals 1 thru 5 end when one Player lays down all the Cards in their hand by melding, laying off, and discarding. In these Deals, discarding when going out is Optional. All Players must then total their Score from the Cards remaining in their Hand and Bonus Meld as shown in "Scoring". Reshuffle all Cards before each Deal. Deal 6 is described below.

For any Deal prior to the 4th Deal, additional Players may enter a Game already in progress by taking the average Score of the existing Players. Entry must be done before a Deal begins. To calculate the average Score, add all existing Scores and divide that Number by the quantity of existing Players.

Any Player can try to reduce their Score by obtaining "Optional" Meld (Options 1 thru 5) in the 6th Deal only. The "Optional Meld" is laid down by itself, or excess Cards can be used to meld a maximum of 3 additional Runs of 3 or 4 Cards. To go out, all Cards in your Hand must be laid down all at one time with no Discard allowed.

Note: Only one of the following Run Options are allowed:

1. Letter Run: all 5 Natural lettered Cards in the suit, "A" through "E". No Wild Cards allowed . . . Subtract 50 Points.
2. Number Run: all 8 Natural Numbered Cards in the Suit, "2" through "9". No Wild Cards allowed . . . Subtract 75 Points.
3. Full Circle Run: all 13 cards in the suit. Any color and quantity of Wild Cards are allowed . . . Subtract 100 Points.
4. Full Circle Run: all 13 Cards in the suit including 4 unlike color Wild Cards . . . Subtract 125 Points.
5. Full Circle Run: all 13 Natural Cards in the Suit, "2" through "A". No Wild Cards allowed . . . Subtract 150 Points Unlike the other 5 Deals, a Discard is not allowed when closing the 6th Deal. In this Deal, only one Player melds. All extra Cards in that Player's Hand must be matched and laid down all at one time. This ends the Game, but the Player going out is not necessarily the Winner, especially if you play the $6^{th}$ Deal using Options discussed below.

If no player can go out, the Hand with the least unmatched Cards goes out.

SCORING

To finalize Scores, each Player must add the total Point Value of the Cards remaining in their Hand to their Score and subtract Bonus/Optional Meld Point Values from their Score as follows:

CARD POINT VALUES

All Numbered Cards ..... Add 5 Points each.

Letter Cards "B" thru "E ..... Add 10 Points each.

Letter "A" Cards ..... Add 20 Points each.

Letter "X" Card (Wild) ..... Add 50 Points each.

Note: If your Score is below the Bonus or Optional Point Value obtained, see "Negative Scores" below.

BONUS POINTS

For each Wild Card color matched to the color of Suit in the Bonus Meld Run ..... Subtract 25 Points.

For each Bonus Meld Set (all four Suits without using Wild Cards) ..... Subtract 50 Points.

OPTIONAL POINTS

For the Player that closed the 6th Deal and had one of the 5 Optional Meld Runs, subtract the applicable Point Value listed in "Optional Meld for 6th deal" (above).

NEGATIVE SCORES

A Negative Score is less than zero. Negative Scores win over Positive Scores. A Negative Score happens when you subtract Bonus or Optional Meld Point Values that are more than your existing Score. Example: the amount to be subtracted is 100 and your Score is 20. This equals a Minus 80 (Negative Score.)

The methods of calculating your Score are as follows:

1. When subtracting from a Positive Score, subtract the Numbers.
   The result may or may not be a Negative Score.
2. When subtracting from a Negative Score, add the Numbers.
   The result will always be a Negative Score.
3. When adding to a Negative Score, subtract the Numbers.
   The result may or may not be a Positive Score.
   If no Negative Scores exist, the lowest Positive Score wins.
   If one Negative Score exists, that Negative Score wins.
   If several Negative Scores exist, the highest Negative Score wins The standard method of play is as Previously described.

If agreed upon, prior to starting the Game, any of the following Optional Methods Of Play can be used:

A. To make the Game more difficult and longer lasting, remove Wild Cards in sets of four (one of each color) from each Deck desired.

Note: Removing Wild Cards makes the Bonus Meld Runs and the Full Circle Runs, (Options 3 and 4) more difficult or impossible to obtain.

B. To make the Game slightly faster, eliminate the "One Card Left" statement and "Draw One" levy.

C. To make the Game considerably faster, either /or all of Deals one, two, and three can be eliminated. Always retain the last Deal with Optional Meld and no discard when melding.

D. This Option is for the 6th Deal only and allows all Players a better chance to win the Game. Those Players who have some of the Runs that are Basic, Bonus or Optional Meld, can be layed down after one Player goes out. No one can meld partial Runs or lay off onto Meld on the Table. Only the Cards that cannot be melded are totaled for the Point Value added to Scores. Subtract the Point Value of any Bonus or Optional Meld from Scores. Also, the Player that goes out receives an award of 100 points subtraction from their score.

E. The Game may be played without the use of "Bonus" or "6th Deal Optional" Meld however, playing the game with the $6^{th}$ deal optional meld is the presently preferred embodiment and best mode now contemplated for carrying out the invention.

4XPOKER GAME RULES (FIRST ALTERNATIVE EMBODIMENT)

A New Game similar to conventional 3, 5,and 7 Card Poker and is Played the same except the New Star Playing Cards are used and the stated rules apply. Rules "C" and "D" do not apply to 3 Card Poker. The Card Decks have 4 different color suits and 4 "X" Cards, one of each Suit Color. Most of the many variations of conventional Poker may also be played with the New Playing Cards.

A. "X" Cards are wild and any Quantity of "X" Cards can be used for any Number or Letter Cards which rank the same as the Cards they replace.

B. The "X" Cards in Flushes, Straight Flushes or Royal Flushes must be of the same color as the suit. Odd color "X" Cards used in Straight/Royal Flushes downgrades them to a Straight.

C. "5 of a Kind" is a regular hand in this Game as it is more easily obtained with the use of 4 "X" Cards per Deck. It ranks above "4 of a Kind" and below a "Straight Flush".

D. An "X" Card used with 2 Pairs to make a Full House, ranks the same as the High Pair.

E. An "X" Card in a Hand that otherwise has No Pairs, ranks with the High Card as a Pair.

F. In 3 Card Poker, a 3 of a Kind Hand with 3 "X" Cards, outranks 3 "A" Cards.

G. Any Hand having all the same color Characters outranks the same combination of Characters in different colors.

H. Hand Rankings.

TABLE 1

| Lowest Number is the Highest Rank | | | |
|---|---|---|---|
| 3 Card: | 1. Straight Flush | 5 & 7 Card: | 1. Straight Flush |
| | 2. Three of a Kind | | 2. Five of a Kind |
| | 3. Straight | | 3. Four of a Kind |
| | 4. Flush | | 4. Full House |
| | 5. Pair | | 5. Flush |
| | 6. High Card | | 6. Straight |
| | | | 7. Three of a kind |
| | | | 8. Two Pairs |
| | | | 9. One Pair |
| | | | 10. High Card |

WILDCAT 22 GAME RULES (SECOND ALTERNATIVE EMBODIMENT)

A New Game similar to Blackjack. It is played the same except the New Star Playing Cards are used and the stated rules apply. It is also similar to the Flush 22 Game with the big difference being the value of the "X" Cards is 1 thru 11 in Wildcat 22 as compared to 1 or 11 in the Flush 22 Game.

This game is very exciting in that many high scores are obtained by every one and Bust scores are less frequent. The 4 "X" Cards (Wild) used in the Game make it more difficult for "Card counters" to keep track of the Cards Played. This feature helps the Casinos reach their Net Gain Goals. High Score is 22. A unique Burgundy Color Cloth Layout is used, SEE FIG. 25.

Pip Values: Numbers 2 thru 9=their Face Value Letter A=1 or 11 Points, Player's Option Letters B. C, D, E=10 Points Each Letter X=1 thru 11 Points, Player's Option A. A "Max-Lo" and "Max-Hi" are New Hands which take the place of a Natural. They consist of two Cards: (A+X); (A+A); (X+X) each totaling 22 points; A "Max-Hi" (same colors) outranks a "Max-Lo" (odd colors). Max Hands have special Payoffs.

TABLE 2

(Chart A)
Chart A: Shows six of the many Possible same and different color Max Hands when using multiple Card Decks. Each Column is a Max Totaling 22 Points. The rank of a Max Hand is determined Only by the colors being the same or different.

| Max- Lo Odd Colors | | | Max- Hi Same Colors | | |
|---|---|---|---|---|---|
| A | A | X | A | A | X |
| X | A | X | X | A | X |

B. If an X Card is obtained a 22 score is assured. This is done by making the value of X equal to what is needed to total 22 points. This results in many 22 Scores making the game More fun.

C. Scores range from 4 to 22 Points. A "Bust" is a losing score over 22 Points. The Dealer has no restrictions as to drawing or standing on any certain value score.

D. Character combinations, or scores made with the same color Cards outrank the same characters or scores made with different color Cards.

E. Any Score made with 2 Cards. outranks the Same Score made with 3 or more Cards.

F. Special Max Bets. placed on the max Line, Pay 20 to 1 if Dealer gets Any Max Hand.

G. Dealer offers Insurance on an A or X Card up. This is a side bet which pays 3 to 1 if Dealer gets Any Max Hand (22 points). It is not Paid on a Natural Hand (21 points).

H. Dealer getting a Max-hi, Max-lo or any 22 score hand immediately clears the table of all outranked hand Bets and Pays any winning Hands. See Chart of Payoffs and Losses for Max Hands.

I. Due to busts happening in few hands, House may opt to collect 50% or 100% of Push Score Bets.

TABLE 3

| Who has a "Max" | "Max- Lo" Hand | "Max- Hi" Hand | Special "Max" Bets |
|---|---|---|---|
| Dealer Only | Dealer Collects Outranked Bets | Dealer Collects All Bets | Dealer pays 20 |
| One or More Players | Dealer Collects Losers Bets and pays Winners | Dealer Collects Losers Bets and pays Winners | times the Bets if |
| Only Dealer and | 1 ½ Times Their Bets Dealer Collects Losers | 2 Times Their Bets Dealer Collects Losers | Dealer gets Any |

TABLE 3-continued

| Who has a "Max" | "Max- Lo" Hand | "Max- Hi" Hand | Special "Max" Bets |
|---|---|---|---|
| One or More Players | Bets and Winners Retain Their Bets | Bets and Winners Retain Their Bet | Max Hand |

FLUSH 22 RULES (THIRD ALTERNATIVE EMBODIMENT)

A New Game similar to Blackjack. It is Played the same except the New Star Playing Cards are used and the stated rules apply.

It is also similar to the Wildcat 22 (Trademark of applicant) game with the big difference being the value of the "X" Cards is 1 or 11 in Flush 22 as compared to 1 thru 11 in the Wildcat 22 Game. High Score is 22. A Unique Green colored Cloth Layout is used. for example, see FIG. 24.

Pip Values: Numbers 2 thru 9= their Face Value

Letters B. C, D, E=10 Points Each

Letters A and X=1 or 11 Points, Player's Option

A. A "Max-Lo" and "max-Hi" are New Hands which take the place of a Natural. They consist of two Cards: (A+X); (A+A): (X+X) each totaling 22 points. A "Max-Hi" (same colors) outranks a "Max-Lo" (odd colors). Max Hands have Special Payoffs.

TABLE 4

Table 4: Shows six of the many Possible same and different color Max Hands when using multiple Card Decks. Each Column is a Max Totaling 22 Points. The rank of a Max Hand is determined Only by the colors being the same or different.

| Max-Lo Odd Colors | | | Max-Hi Same Colors | | |
|---|---|---|---|---|---|
| A | A | X | A | A | X |
| X | A | X | X | A | X |

B. Scores range from 4 to 22 Points. A "Bust" is a losing score over 22 points. The Dealer must draw to 16 and stand on 17 or higher.

C. Character combinations, or scores made with the same color Cards outrank the same Characters or scores made with different color Cards.

D. Any Score made with 2 Cards, outranks the Same Score made with 3 or more Cards.

E. Special Max Bets, placed on the Max Line, Pay 10 to 1 if Dealer gets any Max hand.

F. Dealer offers Insurance on an A or X Card up. This is a side bet which Pays 3 to 1 if Dealer gets any Max Hand (22 points). It is not paid on a Natural Hand (21 Points).

G. Dealer-getting a Max-hi or Max-lo hand immediately clears the table of all outranked hand Bets and pays any winning Hands. See Chart for Payoffs and losses with Max Hands.

H. Due to fewer busts, Casino may opt to collect 50% or 100% of the Push Scores Bets.

TABLE 5

| Who has a "Max" | "Max- Lo" Hand | "Max- Hi" Hand | Special "Max" Bets |
|---|---|---|---|
| Dealer Only | Dealer Collects Outranked Bets | Dealer Collects All Bets | Dealer pays 10 times the Bets if Dealer gets Any Max Hand |
| One or More Players Only | Dealer Collects Losers Bets and pays Winners 1 ½ Times Their Bets | Dealer Collects Losers Bets and pays Winners 2 Times Their Bets | |
| Dealer and One or More Players | Dealer Collects Losers Bets and Winners Retain Their Bets | Dealer Collects Losers Bets and Winners Retain Their Bet | |

What is claimed is:

1. A method of playing a card game for 2 to 10 players, the method comprising:

a) providing a plurality of decks of playing cards comprising a face side and a back side, each deck comprising indications on the face side of four suits, each suit having a unique symbol and a unique color associated therewith, each suit consisting of 14 cards, each card being indicated by one of the numbers and letters 2 through 9, A through E, and X, b) dealing a deal quantity of cards to each player for each of six deals, the deal quantity of cards on the first deal being seven cards, the deal quantity of cards being increased by one card on each deal thereafter until a total of twelve cards are dealt on the sixth deal, the remainder of the cards comprising a face down stockpile, c) removing one card from the stockpile and placing it face up to form a discard pile, d) playing sequentially in turn around the table, each player taking the following turn steps:

d1) drawing one card selected from one member of the group consisting of: the stockpile, the discard pile, d2) if the player has drawn from the discard pile and desires to do so again, drawing at least one additional card from the discard pile and drawing the same number of additional cards from the stockpile, d3) playing, if possible, a meld comprising a grouping of cards in numerical and alphabetical order and numerical and alphabetical sets, d4) ending the player's turn by discarding one card to the discard pile, unless the player has no cards remained in their hand, in which case the deal ends, d5) refreshing the stockpile by reshuffling and inverting the discard pile at any time the stockpile becomes depleted, e) altering the sets required to create a meld for each new deal.

2. The method of claim 1, further comprising providing utilizing a deck comprising on the face side a full circle run indicator showing the order of the cards by means of a circular depiction of the numbers and letters of the cards.

3. The method of claim 1, further comprising providing a deck comprising on the face side of the E card the additional annotation 10.

4. The method of claim 1, further comprising providing a deck comprising on the face side of the A card the additional annotation 1.

5. The method of claim 1, further comprising allowing the X card to be utilized by the players as a wild card to complete a run or set.

6. The method of claim 1, further comprising the step of keeping a score for each player at the end of each deal by adding a number of points to each player's score based upon the amount and selection of cards in the player's hand when another player ends the deal.

7. The method of claim 6, further comprising allowing players to accumulate negative points by completing a bonus meld in any deal.

8. The method of claim 6, further comprising allowing new players to join the game at step b), prior to the deal, provided the player is assigned a score consisting of the average score of all players already playing.

* * * * *